US006201595B1

(12) United States Patent
Maess et al.

(10) Patent No.: US 6,201,595 B1
(45) Date of Patent: Mar. 13, 2001

(54) MODULAR ELECTROPHOTOGRAPHIC COLOR PRINTER

(75) Inventors: Volkhard Maess, Erding; Martin Schleusener, Zorneding, both of (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 09/284,714

(22) PCT Filed: Oct. 16, 1997

(86) PCT No.: PCT/DE97/02390

§ 371 Date: Apr. 19, 1999

§ 102(e) Date: Apr. 19, 1999

(87) PCT Pub. No.: WO98/18057

PCT Pub. Date: Apr. 30, 1998

(30) Foreign Application Priority Data

Oct. 17, 1996 (DE) ..... 196 42 889

(51) Int. Cl.[7] ..... G03B 27/32; G03B 27/52; G03G 15/01

(52) U.S. Cl. ..... 355/40; 355/26; 399/232; 399/298

(58) Field of Search ..... 399/298, 299, 399/301, 143, 232; 355/326 R, 24, 26, 27–29, 40, 41; 346/153.1; 430/45, 42; 34/117

(56) References Cited

U.S. PATENT DOCUMENTS

| | | | | |
|---|---|---|---|---|
| 4,078,929 | | 3/1978 | Gundlach | 96/1.2 |
| 5,014,094 | | 5/1991 | Amitani et al. | 355/326 |
| 5,138,363 | * | 8/1992 | Yuge | 355/24 |
| 5,153,615 | * | 10/1992 | Snelling | 346/153.1 |
| 5,185,619 | * | 2/1993 | Snelling | 346/153.1 |
| 5,394,230 | * | 2/1995 | Kaukeinen et al. | 355/326 R |
| 5,537,198 | * | 7/1996 | Jackson | 355/326 R |
| 5,557,393 | * | 9/1996 | Goodman et al. | 355/326 R |
| 5,612,771 | * | 3/1997 | Yamamoto et al. | 399/301 |
| 5,740,510 | * | 4/1998 | Van de Bogaert et al. | 399/298 |
| 5,765,081 | * | 6/1998 | Bogaert et al. | 399/299 |
| 5,914,741 | * | 6/1999 | Snelling et al. | 347/117 |
| 5,916,718 | * | 6/1999 | Kellie et al. | 430/45 |
| 5,920,755 | * | 7/1999 | Nelson | 399/298 |
| 5,985,499 | * | 11/1999 | Guth et al. | 430/42 |

FOREIGN PATENT DOCUMENTS

| | | |
|---|---|---|
| 44 34 081 A1 | 5/1995 | (DE) . |
| 0 659 569 A1 | 6/1995 | (EP) . |

OTHER PUBLICATIONS

Xerox Disclosure Journal, Tandem Trilevel Process Color Printer, No. 6, 1991, pp. 389–390.

* cited by examiner

*Primary Examiner*—Russell Adams
*Assistant Examiner*—Hung Henry Nguyen
(74) *Attorney, Agent, or Firm*—Schiff Hardin & Waite

(57) ABSTRACT

An electrophotographic color printer includes a photoconductor and a printing unit for producing a toner image on the photoconductor. The printing unit is removably provided in a receptacle in the printer.

13 Claims, 5 Drawing Sheets

MODULAR ELECTROPHOTOGRAPHIC COLOR PRINTER

BACKGROUND OF THE INVENTION

1. Field of the Invention

The present invention is directed to an electrophotographic printer for printing a final image carrier, having a transport for transporting the final image carrier, a first printer unit for generating a first toner image on the basis of a first arrangement of color particles on a first photoconductor, at least one further printer unit for generating a further toner image on the basis of a further arrangement of color particles on a further printer, and a transfer apparatus for direct or indirect transfer of the first toner image from the first photoconductor and of the further toner image from the further photoconductor onto a surface section of the front side of the final image carrier.

2. Description of the Related Art

The term a color separation generally refers to a toner image that was applied by a single developer station. A multi-colored print image consequently arises by superimposition of a plurality of color separations.

A printer which uses color separation is disclosed, for example by European published application EP 0 659 569 A1. Given the printer described therein, the first single-color toner image (or color separation) is fixed by the first printer unit before the second toner image, which is likewise of a single-color, is applied onto the already fixed, first toner image. An exactly registered multi-color printing is not possible with the known printer since it cannot be assured that the two toner images are printed exactly on the same surface section of the carrier material. As a result thereof, the picture elements of the first toner image and of the second toner image may also not be aligned exactly relative to one another. The result is that undesired superimpositions or empty spaces between picture elements of different toner images arise (this also being known as registration error). High quality color printing is ultimately not possible. Given graduated, planar color printing, color errors and color seams arise. Further, unsharp and/or color-falsified image details arise in the region of the lines and written characters when printing lines and written characters.

The printer according to the above-cited published application is also inflexible with respect to an being adopted to different printing jobs. When, for example, printing is to be carried out with only one color, then the second printer according to said published application is superfluous. Moreover, a color pallet of four predetermined colors can only be selected when printing with the printer according to the European patent document EP 0 658 569 A1.

Published German application DE 44 34 081 A1 discloses a printer for multi-color printing that contains four printer units, each having a respective photoconductor. The apparatus disclosed therein for avoiding registration errors requires a complicated adjustment procedure wherein what are referred as eccentricity phases must be taken into consideration.

SUMMARY OF THE INVENTION

An object of the present invention is to provide a printer that enables a high-quality multi-color printing with a relatively simple structure and that can be adapted to different printing jobs with respect to the registration precision between specific color separations.

This object is achieved by a printer comprising a conveyor for conveying the final image carrier, a first printer unit for generating a first toner image on a basis of a first arrangement of color particles on a first photoconductor, at least one further printer unit for generating a further toner image on a basis of a further arrangement of color particles on a further photoconductor, a transfer station for the direct or indirect transfer of the first toner image from the first photoconductor and of the further toner image from the further photoconductor onto a surface section on the front side of the final image carrier, and an assembly for acceptance of the first printer unit in a first receptacle and for acceptance of a further printer unit in a further receptacle, a first developer station for application of color particles of a first color with a first polarity onto at least one first surface element of the first photoconductor, a second developer station contained in the first printer unit for applying color particles of a second color different from the first color with a second polarity opposite the first polarity onto at least one second surface element of the first photoconductor. A printer of the present invention has an assembly for accepting the first printer unit in a first receptacle and for accepting the further printer unit in a further receptacle. Since the receptacles are arranged in an assembly, the spatial distance between the receptacles is slight. The receptacles are preferably arranged immediately next to one another. The printer of the invention thus requires little installation space. A multitude of printing possibilities derive as a result of two printer units arranged following one another. Thus, for example, toner images can be printed on top of one another, as a result whereof subtractive color mixing can be achieved.

The invention is based on the perception that the picture elements when applying a toner image do not deviate from their predetermined positions (to result in exact-registration printing). The color particles of two colors are therefore applied in the invention when applying one of the toner images with two developer stations that are arranged in the same printer unit and at the same photoconductor. An additive color mixing is thus already possible within a toner image. For example, a printer unit can realize the method disclosed by U.S. Pat. No. 4,078,929 that is also known under the name "Tri-Level Method". A registration error is unavoidable given toner images produced by different printer units.

The first receptacle and the further receptacle in an exemplary embodiment of the invention have essentially the same structure in the invention and the printer units are detachably introduced into the receptacles. As a result of the identical structure of the receptacles and the detachability of the printer units, it is assured that printer units can be replaced with one another and that an expedient number of printer units can be introduced into the receptacles dependent on the print quality required. An adaptation of the improved or, respectively, newly developed printer units is possible when care is exercised in the design of these printer units to see that they can be introduced into the receptacles.

In the invention, at least one of the printer units is detachable introduced into one of the receptacles, i.e. this printer unit can be introduced into the respective receptacle in a simple fashion or, respectively, can be removed from this receptacle. Included within the space of this invention are all measures known to a person skilled in the art such as, for example, latching or interlocking the respective printer unit in the receptacle. What this measure achieves is that the printer of the invention can be adapted to different printing jobs fast, i.e. with few manipulations, in that the detachable printer unit is removed or introduced or, respectively, is replaced by a different printer unit. Moreover, a replacement of developer stations in the printer unit, a replenishing of toner and the implementation of maintenance work are facilitated in that a printer unit is removed from the assembly for the respective activity and is reintroduced after the end of the activity.

The printer of the invention can print the final image carrier, for example sheet-shaped material that is preferably paper, directly or indirectly. Given indirect printing, an intermediate carrier is employed onto which the toner images are transferred before they are ultimately transferred onto the final image the carrier. Wherein an intermediate carrier is employed as carrier material in an exemplary embodiment of the invention, then—among other things—the superimposition of the toner images of different printer units can ensue more exactly. The registration precision is thereby enhanced because the photoconductor and the intermediate carrier are easier to synchronize than the photoconductor and the final image carrier. Moreover, the intermediate carrier is composed of a material that is selected with respect to the interaction between the photoconductor and the intermediate carrier in view of abrasion and chemical influencing. As a result thereof, the photoconductor is worn less and more uniformly than would be the case of an interaction with a final image carrier of, for example, paper. Further, an exemplary embodiment of the invention is directed to a printer that is suitable for both-sided printing.

The invention is also directed to an electrophotographic printer for multi-color printing as follows. This printer works according to a method that is referred to below as repetition printing, whereby the final image carrier or, respectively, the intermediate carrier is multiply conducted past a printer unit that successively applies at least toner images onto the same surface section of the carrier material. When the first toner image applying in a first printing step has color particles of two colors, then it is assured that the picture elements with these colors are aligned exactly relative to one another. When a further toner image generated in a further printing step is superimposed on the first toner image, then registration errors occur only between toner images of different printer units. The result is that the printing quality is enhanced. As a result of the possibility of repetition printing, additional printer units can be foregone given the same printing quality, whereby, however, a longer printing time and, thus, a reduced number of pages printed per time unit must be accepted. Given the printer of the invention, however, a further printer unit can, for example, be introduced into one of the printer receptacles at a later point in time, so that the repetition printing can be replaced by mutli-color printing in a single pass.

In a further exemplary embodiment of the invention, the colors are selected from a plurality of possible colors of a color pallet, being selected by the printer control. Each individual color of the color pallet is allocated to a developer station of one of the printer units whose toner images are applied on the front side or, respectively, back side of the final image carrier directly or indirectly. As a result thereof, it is possible that the colors which are suitable for the respective employment are selected according to the predeterminations of an operator and/or by an automatic print job control without one or more developer stations having to be manually replaced. In addition to the primary colors, for example, additional decorative colors such as gold or silver can thus be printed.

In a further exemplary embodiment of the invention, the developer stations are detachably introduceable, i.e. the developer stations can be introduced into the printer units or, respectively, removed from the printer units in a simple way. When the print controller, instead of activating at least one of the developer stations, optionally activates an additional developer station for applying color particles of an additional color, then other mixed colors are produced. In this way, the printable color space can be adapted to the printing job. When a greater number, for example, ten through twenty predetermined colors are present in developer stations outside the printer that can be introduced into the printer units with few manipulations and can be selected with the assistance of the print controller, then the printer can be quickly and simply adapted to the plurality of printing jobs. Developer stations having color particles of the same polarity can be arbitrarily interchanged with one another since they function in the same way.

These two latter exemplary embodiments are based on the perception that printing a few, for example, 2, 3 or 4 color separations leads to adequately good color quality for many color printing applications such as, for example, business graphics, and that the registration precision of the color separations critically determines the targeted printing quality given these printing applications. These printing applications are referred to as business color printing (business color). The desired, targeted business color printing quality is achieved in that a print image is produced by only a single printer unit with two developer stations. By replacing the developer stations with developer stations having different toner colors, the printable color range can thus be adapted quickly and simply to different printing goals. In any case, two color images without registration errors are produced by each printer unit. For replacing the developer stations, only the stations having the same toner polarity can be interchanged with one another.

These two latter exemplary embodiments are also based on the perception that subtractive color mixing of the primary colors yellow, magenta, cyan are required for full color printing with high color quality, whereby the pure mixed colors red, blue, green arise by superimposed printing of respectively two primary colors. The superimposed printing of the toner images of two primary colors requires that these be produced by developer stations of different printer units can be successively transferred onto an image carrier.

In one exemplary embodiment of the invention, the fixing process of the toner images only ensues after the toner images have been transferred and, potentially, a multi-color print image has been applied onto both sides of the carrier material. As a result of this measure, it is possible to enhance the registration precision when placing the toner images on top of one another, since the carrier material is not influenced by the heat occurring when fixing solid color particles. Moreover, further fixing stations are eliminated, so that the printer is simply constructed and consumes considerably less energy. Due to the elimination of the further fixing station, the required installation space is small given a printer according to this exemplary embodiment of the invention.

The invention can be implemented with a dry toner that contains only solid color particles or with a liquid toner in which, for example, the color particles are contained in a color liquid.

BRIEF DESCRIPTION OF THE DRAWINGS

The invention is described below with reference to exemplary embodiments. Thereby shown are.

DETAILED DESCRIPTION OF THE PREFERRED EMBODIMENTS

Figure 1:
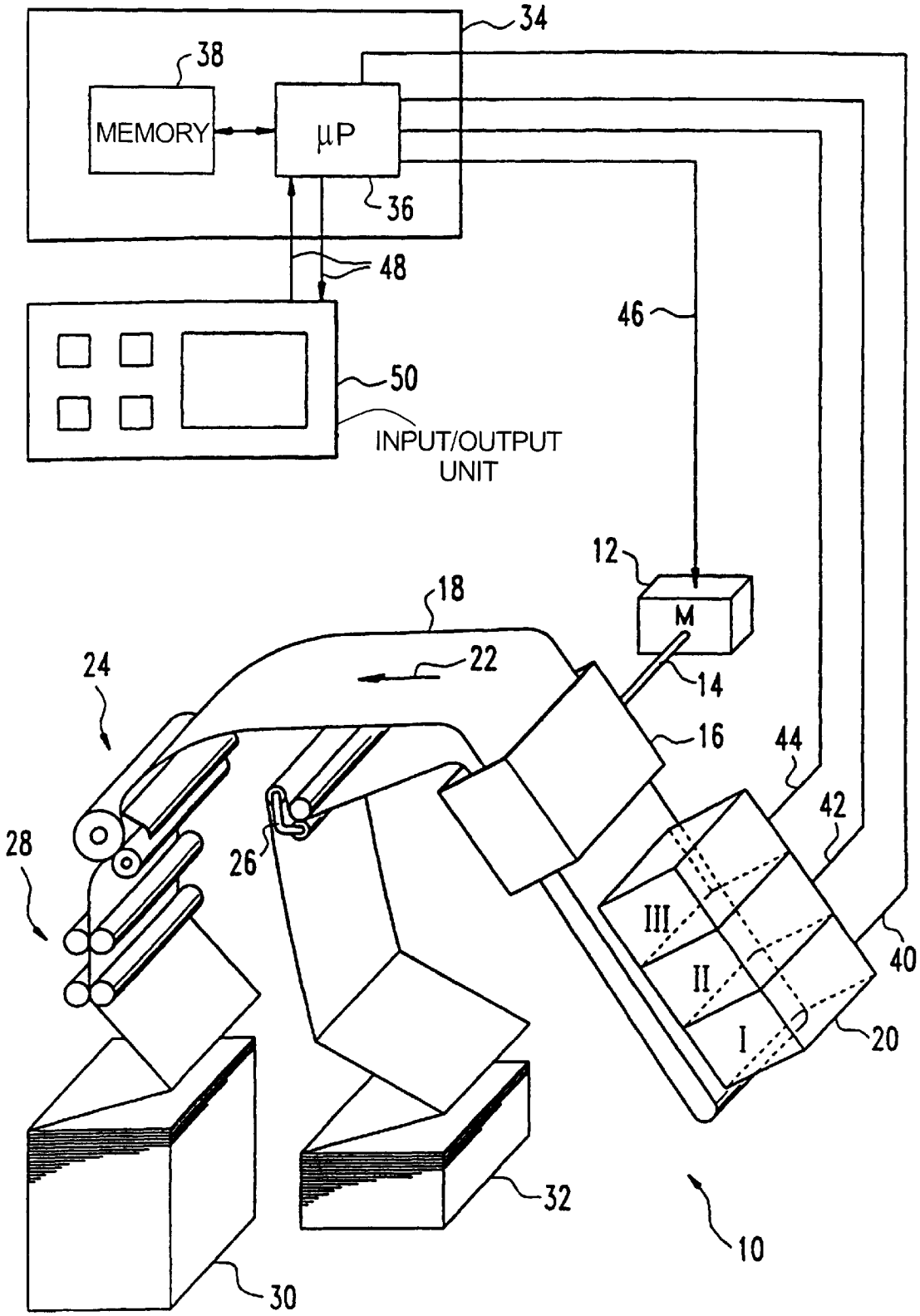
FIG. 1 a schematic illustration of an electrophotographic printer with critical electronic and mechanical function units.

FIG. 1 shows a schematic illustration of an electrophotographic printer 10 for a multi-color printing in which only critical electrical and mechanical function units are known. The printer 10 has the transport means 16 driven by a motor 12 via a shaft 14 for transporting a carrier material 18 past a printer unit receptacle 20, essentially according to a predetermined printing speed VD. Alternatively to the continuous form carrier material 18, single sheets, fabric (for example T-shirts), plastic films or sheet metal (for example, four beverage cans) can be printed given a modified transport.

Dependent on the printing demands with respect to the quality of the print image and the plurality of colors to be printed printing units are accepted in print unit insert I through III in the print unit receptacle 20, these being arranged following one another in a conveying direction illustrated by an arrow 22. The structure of a printer unit shall be explained later with reference to FIG. 4. The printer units can be inserted into the printer unit inserts I through III in a simple way, for example with few manipulations, or be removed therefrom.

Figure 2:
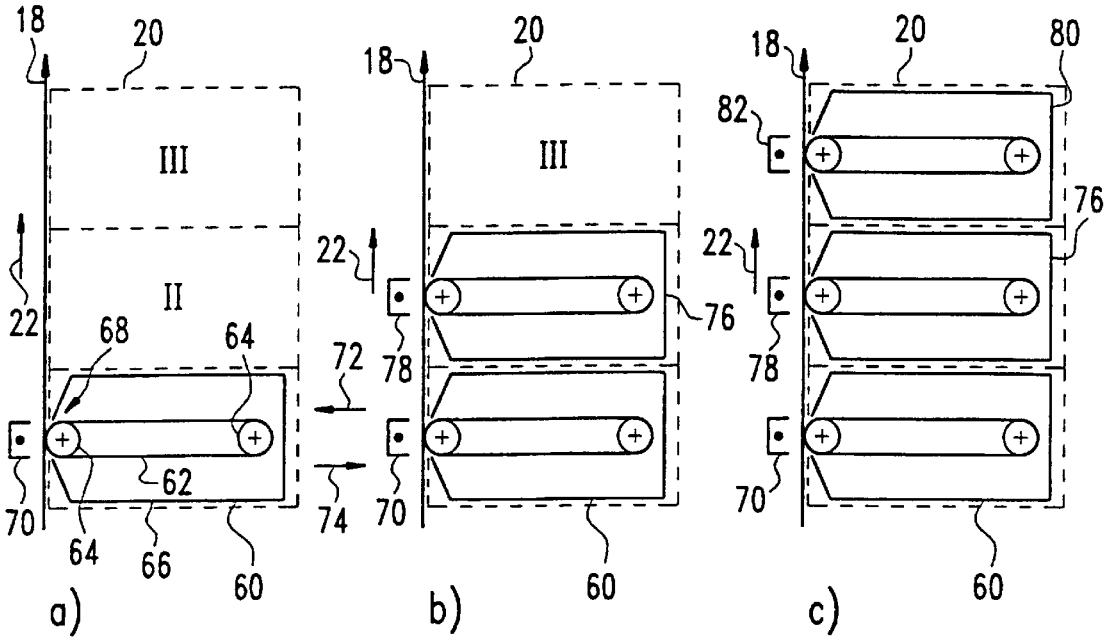
FIG. 2 a printer unit receptacle with a printer unit, two printer units or, respectively, three printer units as well as with intermediate carriers.

A printer unit in the printer unit insert I generates a first toner image that is transferred onto the carrier material 18 with the assistance of a transfer corona means (see part a of FIG. 2). Printer units in the printer unit inserts II or, respectively III, likewise generate a second or, respectively third toner image that is transferred onto the carrier material 18 as well with the assistance of transfer corona means (see part b and part c of FIG. 2) allocated to the printer units. The second toner image is applied immediately over the first toner image and the third toner image is applied immediately over the second toner image, so that the toner images superimpose to form the print image.

After the carrier material 18 has been transported past the printer unit receptacle 20, in which the toner images that are still smearable are fused smear-proof to the carrier material 18 with the assistance of pressure and temperature in the fixing means 24. A first deflection unit 26 that conducts the carrier material 18 to the printer unit receptacle 20 is arranged preceding the print unit receptacle 20 as viewed in the conveying direction 22. A further deflection unit 28 stacks the printed carrier material 18 onto a stack 30. The carrier material 18 is taken from a stack 32 by the first deflection unit 26 at the beginning of the printing process. Instead of the two stacks 30 and 32, rolls on which the carrier material 18 is rolled up are also employed. The printing event is controlled by a print controller 34 that contains at least one microprocessor 36 and a memory 38. The microprocessor 36 processes a printing program stored in the memory 38 and thereby controls the printing process. The print controller 34 also at its image data likewise stored in the memory 38 and transmits the edited image data via control and data busses 40, 42 or, respectively, 44 to the printer units in the printer unit inserts I, II or, respectively, III. The motor 12 is driven such by the print controller 34 via a control line 46 that, dependent on the print units present in the print unit receptacle 20, the carrier material 18 has an optimum conveying speed that essentially coincides with a respective, optimum printing speed VD.

The print controller is connected via data lines 48 to an input/output means 50 via which—among other things—specific colors from a color pallet can be defined for the printing.

Here to shows the printer unit receptacle 20 with one printer unit, two printer units or, respectively, three printer units. Part a of FIG. 2 shows the printer unit receptacle 20 with a printer unit 60 in the print unit insert I. The functioning of the printer unit 60 is explained in detail later with reference to FIG. 4. A photoconductor 62 is situated in the printer unit 60, this photoconductor 62 being composed of a flexible material and being conducted within the printer unit 60 around two deflection rollers 64 in the fashion of a conveyor belt. The printer unit 60 is surrounded by a chassis 66 composed of a stable material. The chassis 66 has an opening 68 past which the photoconductor 62 is conducted in the inside of the printer unit 60. Outside the printer unit 60, the carrier material 18 is conducted at the opening 68. A transfer corona means 70 is arranged lying opposite the opening 68, a toner image located on the photoconductor 62 being capable of being transferred onto the carrier material 18 with the transfer corona means 70.

The printer unit 60 can be inserted into the printer receptacle 20 in the direction of an arrow 72 until it engages into a catch receptacle (not shown). The printer unit 60 can in turn be removed from the printer receptacle 20 by releasing the catch and by being moved in the direction of an arrow 74, for example in order to replenish toner of a specific color, to change colors or to implement repairs in the printer unit 60.

The version of the printer receptacle 20 with a printer unit 60 shown in part a of FIG. 2 represents a basic version which already enables a later expansion or an adaptation to more advanced printer units during manufacture of the printer 10. Color combination possibilities already derive with a single printer unit 60. In addition to black toner particles, for example, toner particles of a different color can also thus be applied onto the photoconductor 60 and, subsequently, onto the carrier material 18 as a first toner image. For black-white printing, only toner particles of the color black are applied onto the photoconductor 62 in that the print controller 34 activates only one developer station for black toner particles. The printing speed VD is independent of whether one or two developer stations are activated.

The developer stations can be individually introduced into or, respectively, removed from the printer unit 60, as a result whereof specific colors can be offered in the printer unit 60 before initialization of the printer unit 60 dependent on the printing demands. The print controller 34 activates the developer stations required for printing during printing. When more than two developer stations are contained in the printer unit 60, i.e. more developer stations than can be simultaneously activated, then the variability is enhanced again since the print controller 34 can activate other developer stations when printing different toner images dependent on the prescribed printing. When, for example, four developer stations are present in the printer unit 60, then respectively two developer stations selected by the print controller 34 from the four existing developer stations can be simultaneously activated when a printing a toner image.

When employing two colors such as, for example, red and green or, respectively, red and blue, a plurality of mixed colors can be printed with the printer unit 60 according to the version of the part a of FIG. 2 by additive color mixing of these colors printed in juxtaposition. An exactly registered printing is thereby achieved.

Part b of FIG. 2 shows the printer unit receptacle 20 with two printer units in the printer unit inserts I and II. The printer unit 60 is located in the printer unit insert I. Printer unit 76, which is essentially constructed like the printer unit 60, is situated in the printer unit insert II, which is constructed like the printer unit insert I. Of course, the printer unit 76 can contain different toner colors then the printer unit 60. The printer unit 76 has a transfer corona means 78 allocated to it that transfers a toner image generated by the printer unit 76 onto the carrier 18. With the version according to part b, it is possible to also implement a subtractive color mixing in addition to an additive color mixing.

Part c of FIG. 2 shows the printer unit receptacle 20 with the two printer units 60 and 76 as well as a further printer unit 80 inserted into the printer unit insert III, this printer unit 80 being likewise constructed essentially like the printer unit 60. The printer unit 80 likewise has a transfer corona means 82 allocated to it. The version according to part c enables full-color printing without special handling of the color information of the printer language by the printer controller 34. The primary colors yellow, magenta, or cyan are distributed onto the printer units 60, 76 and 80 such that one of the respective primary colors is contained in each printer unit 60, 76 or 80. When one of the printer units 60, 76 or 80 contains black toner particles, then the print quality can be enhanced again since pure black can generally not be composed adequately well from the primary colors. Additional toner particles which are specific decorative colors such as, for example, silver or gold can be distributed onto developer stations that are still free in the three printer units 60, 76 or, respectively, 80. Given employment of glazing toners—which do not completely absorb incident light, so that it impinges a toner layer lying therebelow—, full-color printing can thus be implemented.

Figure 3:
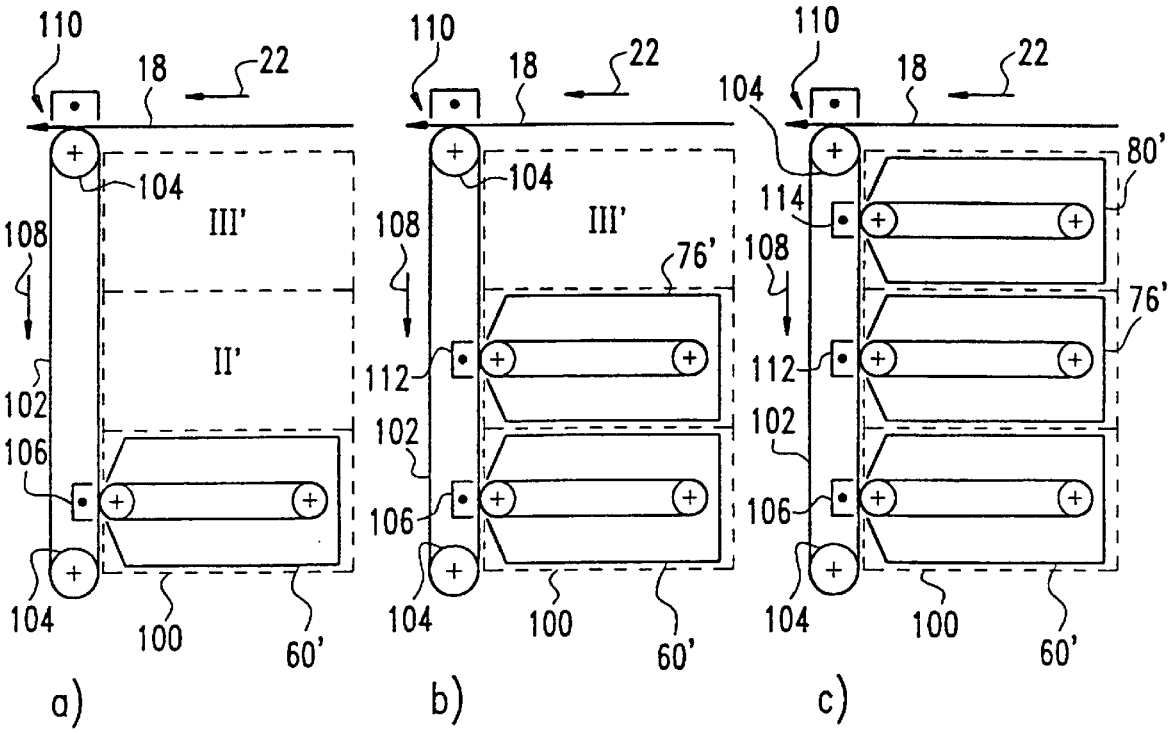
FIG. 3 a second printer unit receptacle with one printer unit, two printer units or, respectively, three printer units.

In parts, a, b, or, respectively, c, FIG. 3 shows a second printer unit receptacle 100 with printer unit inserts I', II' and II' that, by contrast to the printer unit inserts I, II and III, contain printer units 60'; 60', 76' or, respectively, 60', 76', 80'. The printer units 60', 76' and 80' generate toner images that are not transferred onto the carrier material 18 but onto an intermediate carrier material 102, so that an indirect printing ensues. The intermediate carrier material 102 is composed of a flexible material that is conducted around two deflection rollers 104 in the fashion of a continuous band. The printer modules 60', 76' and 80' are constructed essentially like the printer modules 60, 76 and 80.

Part a of FIG. 3 shows the printer unit receptacle 100 with a printer unit 60' in the printer unit insert I, this generating a toner image that is transferred with the transfer corona means 106 onto the intermediate carrier 102. The intermediate carrier material 102 is conveyed in the direction of the arrow 108. When the toner image reaches a transfer printing location 110, then the toner image is transferred onto the carrier material 18 at the transfer location 110, this carrier material 18 being likewise conveyed past the transfer printing location 110. That stated with reference to part a of FIG. 2 applies with respect to the color combinations to be printed.

Part b of FIG. 3 shows the print unit receptacle 100 with two printer units 60' and 76' in the printer unit inserts I' and II'. The intermediate carrier material 102 is selected such with respect to its carrier properties that the toner images can be applied with high precision onto the intermediate carrier material 102 and the position deviations of the picture elements of various toner images from rated positions are extremely slight. The quality of the mutli-color printing is enhanced by employing the intermediate carrier material. The printer unit 76' has a corona means 112 allocated to it that transfers a toner image generated by the printer unit 76' onto the intermediate carrier and superimposes it on the toner image generated in the printer unit 60'. That stated with respect to part b of FIG. 2 applies with respect to the colors to be printed.

Part c of FIG. 3 shows the printer unit receptacle 100 with three printer units 60', 76' and 80' in the printer unit inserts I', II' and III'. The printer unit 80' has a transfer corona means 114 allocated to it for transferring the toner image generated by the printer unit 80' onto the intermediate material 102. That stated with reference to part c of FIG. 2 applies with respect to the possible printing colors.

Figure 4:
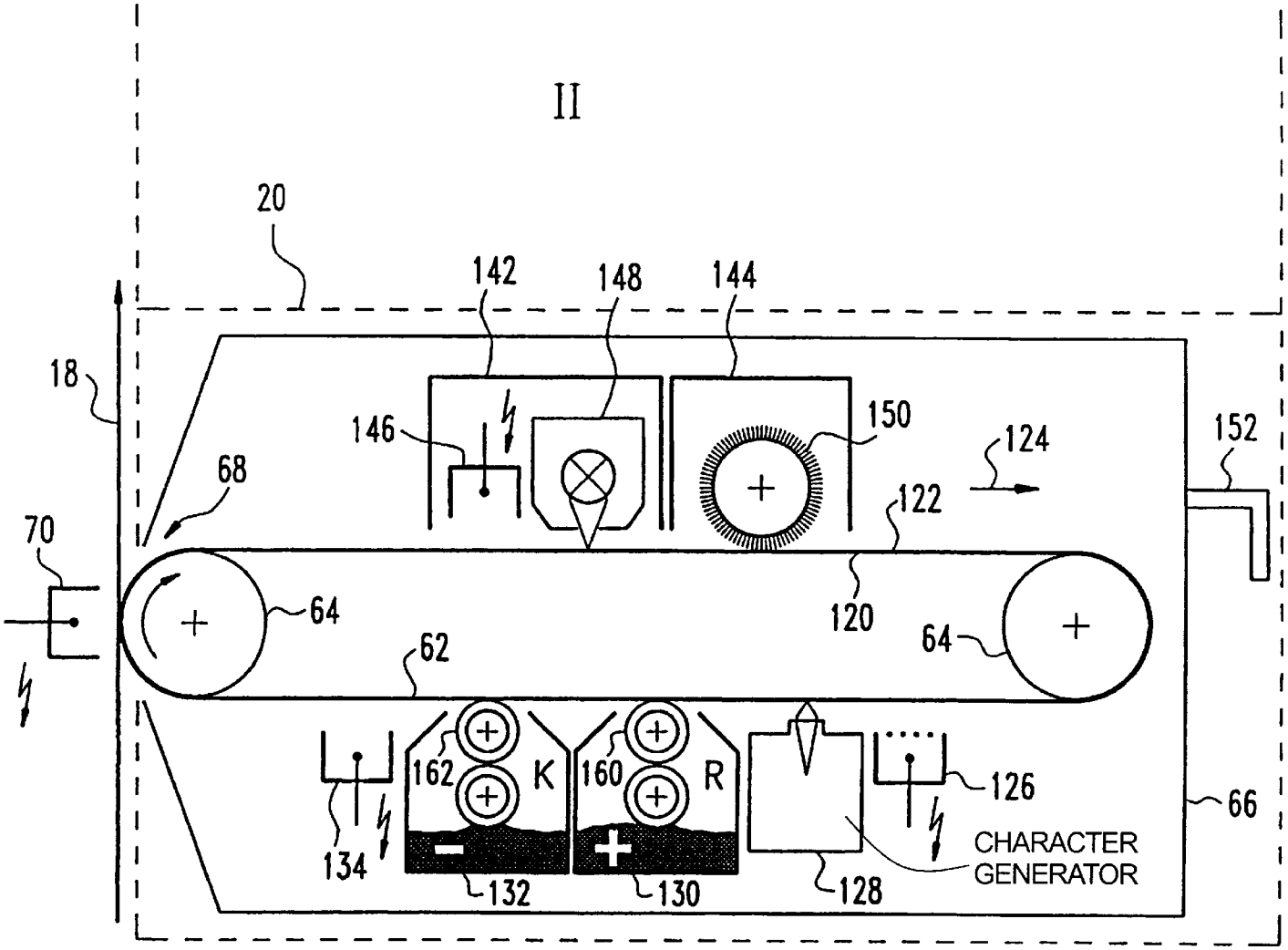
FIG. 4 the critical functional components of a printer unit.

FIG. 4 shows the critical functional components of the printer unit 60. The photoconductor 62 is composed of an electrode layer 120 carrying a zero potential and of a photoconductor layer 122 arranged approximately parallel thereto that is an electrical and mechanical contact with the electrode layer 120 in large-area fashion. The photoconductor 62 is moved in the direction of an arrow 124 by the deflection rollers 64. A surface stripe of the photoconductors 62 lying transverse to the conveying direction is thereby successively conducted past a charging means 126, a character generator 128, a developer station 130 for applying positively charged toner particles, a developer station 132 for applying negatively charged toner particles, a recharging station 134, the corona means 70, an erase means 142 and a cleaning means 144.

The charging means 126 contains a corona means arranged transversely relative to the conveying direction 124 that charges a surface stripe of the photoconductor 62 respectively lying transverse relative to the conveying direction 124 and that is located in the immediate proximity of the charging means 126 such that an initial potential VA of approximately −800 V arises on the surface of the photoconductor layer in the region of the surface stripe.

The character generator 128 contains a line of light-emitting diodes arranged transversely relative to the conveying direction that respectively illuminate a region of the photoconductor 62 lying transverse relative to the conveying direction 124. The character generator 128 is driven such by the print controller 34 that respective image signals for picture elements of a line of the print image are simultaneously converted into luminous signals of the light-emitting diodes. Due to the illumination of the photoconductor 62, the potential on the illuminated surface elements of the photoconductor 62 rises since the photoconductor 62 conducts better in the illuminated region, as a result whereof charge carriers can flow from the photoconductor layer 122 to the electrode layer 120 in the region of the illuminated surface elements. Surface elements on which red toner particles are to be applied are not illuminated; surface elements onto which no toner particles are to be applied are illuminated with a first luminous energy; and surface elements onto which black toner particles are to be applied are eliminated with a second luminous energy that is higher compared to the first luminous energy. The illumination with different luminous energies is achieved in that the light-emitting diodes emit with essentially the same luminous intensity but over time spans of different lengths. The potential on the respective surface elements increases with increasing exposure time, i.e. with increasing luminous energy.

The developer station 130 applies positively charged color particles of the color red R onto surface elements that were not illuminated, employing an auxiliary electrode 160 with a potential VBIAS3.

The second developer station 132 applies negatively charged toner particles of the color black K onto surface elements that were illuminated with the second luminous energy with the assistance of an auxiliary electrode 162 having a potential VBIAS4.

The positively charged, red toner particles have their charge reversed in the recharging station 134, so that all toner particles which have been applied on the photoconductor 62 are negatively charged. What this measure achieves is that the transfer of the toner image from the photoconductor 62 onto the carrier material 18 is reliably implemented with the assistance of the corona means 70.

After the transfer of the toner image, the photoconductor 62, which is now essentially free of color particles, is conducted past the erase means 142. The erase means 142 contains a corona means 146 and an illumination unit 148 with which residual charges present on the photoconductor are removed.

Toner particles that still remain on the photoconductor 62 after the transfer of the toner image are removed from the photoconductor 62 in the cleaning means 144 with the assistance of a brush 150. After being conveyed past the cleaning means 144, the stripe of the photoconductor 62 under consideration is again in a clean initial condition and comprises approximately the same potential at all locations.

The chassis 66 has a handle 152 at its side facing away from the carrier material 18 with which the printer unit 60 can be comfortably and conveniently removed from the printer unit insert I or introduced into the printer unit insert I.

Figure 5:
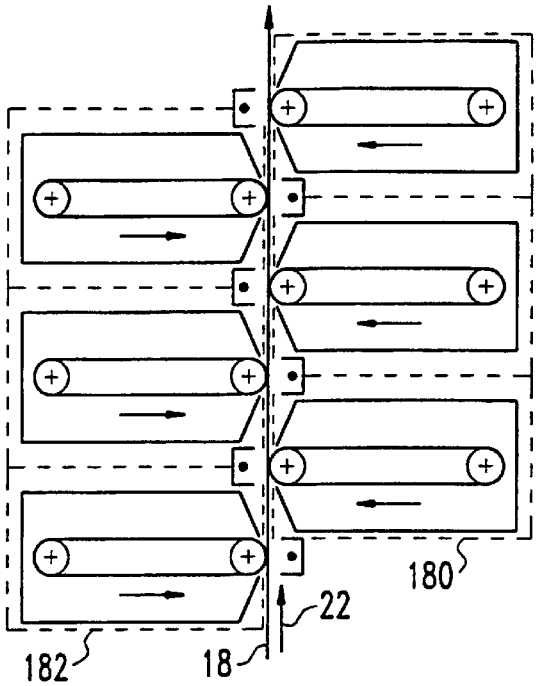
FIG. 5 an exemplary embodiment of a printer of the invention with two printer unit receptacles.

FIG. 5 shows an exemplary embodiment of a printer according to the invention with two printer unit receptacles 180 and 182 that are each respectively constructed like the printer unit receptacle 20. A both-sided printing of the carrier material 18 can ensue with the arrangement shown in FIG. 5. A printer with two printer unit receptacles 180, 182 according to FIG. 5 can be adapted to a broad spectrum of customer wishes and printing qualities, given, for example, three supplied printer units, all three printer units can thus be inserted in the printer unit receptacle 180 or in the printer unit receptacle 182. Alternatively, the three printer units for both-sided printing can also be distributed onto the two printer receptacles 180 and 182. A both-sided printing, however, is also possible without the printer unit receptacle 182 when the carrier material 18 is turned over after a first printing and is conducted past the printer unit receptacle 180 again and printed.

Figure 6:
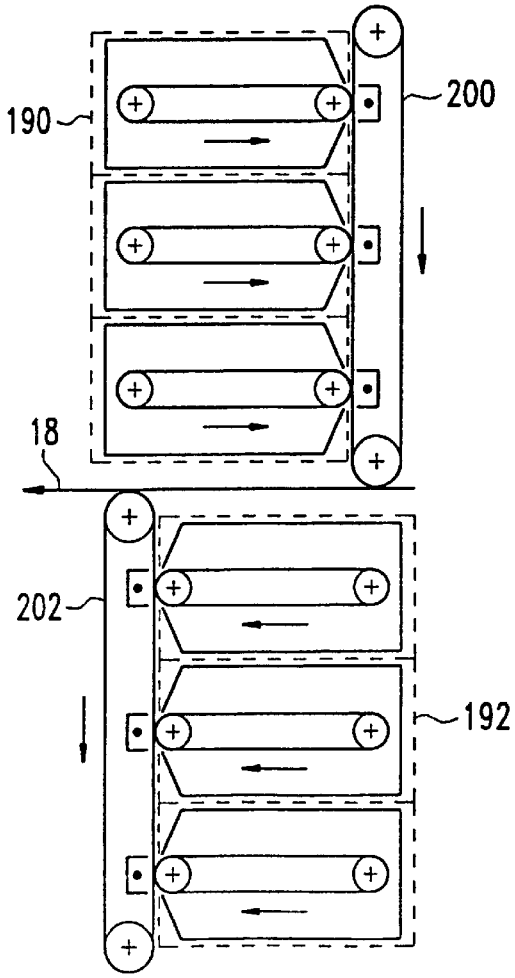
FIG. 6 a further exemplary embodiment of a printer of the invention with two printer unit receptacles as well as with intermediate carriers.

FIG. 6 shows a further exemplary embodiment of a printer of the invention comprising two printer unit receptacles 190 and 192. The printer unit receptacles 190 and 192 are respectively fashioned similar to the printer unit receptacle 20. The difference compared to FIG. 6 is comprised therein that, in FIG. 5, toner images are not transferred directly onto the carrier material 18 by the printer units but are transferred onto the carrier material 18 via intermediate carrier materials 200 or, respectively, 202. A both-sided printing is consequently possible with the version shown in FIG. 6 without having the carrier material 18 enter into contact with the photoconductors of the printer units. Wear of the photoconductors by the carrier material 18 is thus avoided.

Figure 7:
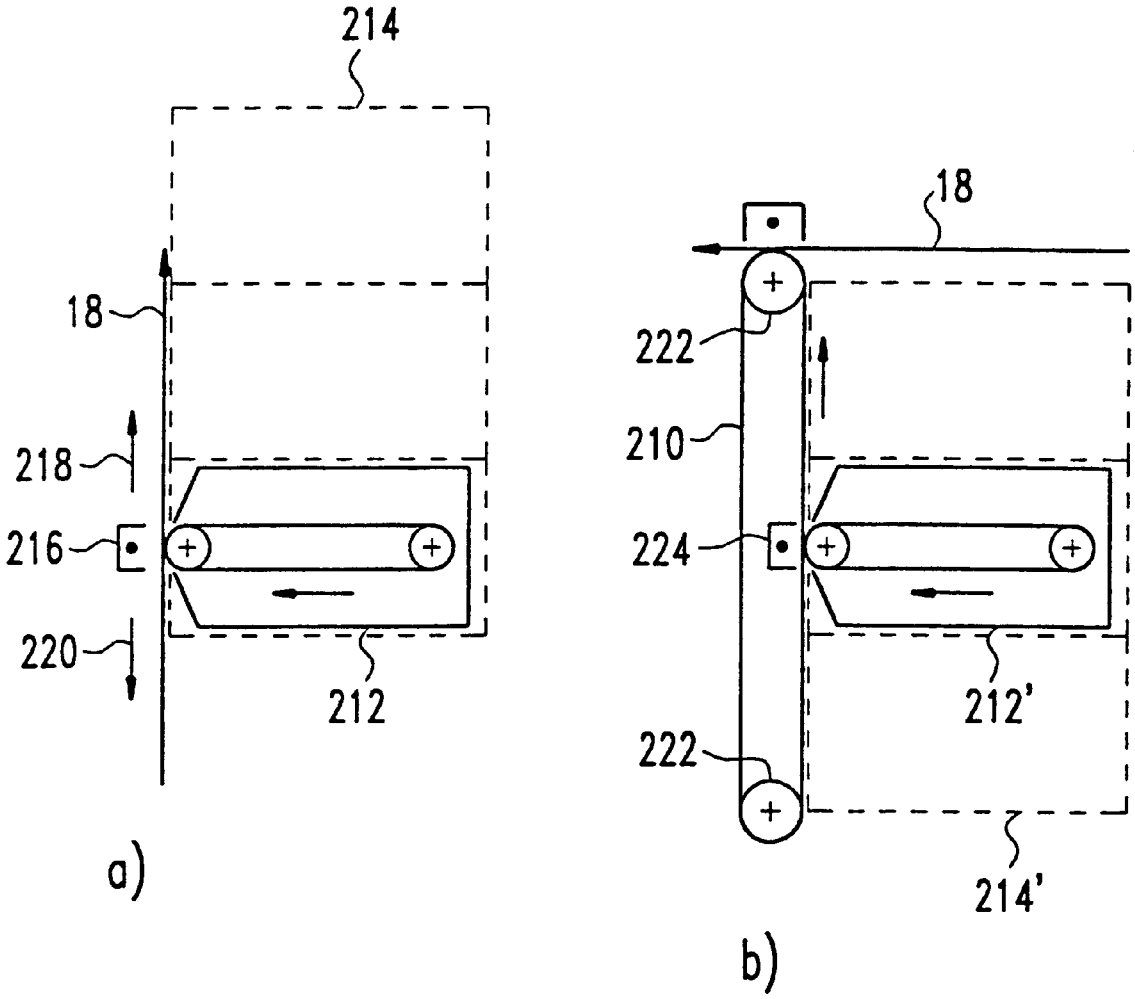
FIG. 7 two possibilities of repetition printing in a further exemplary embodiment of a printer of the invention.

FIG. 7 shows two possibilities of what is referred to as "repetition printing". Instead of two or three printer units that work parallel in terms of time, respective toner images are produced with only one printer unit in two or, respectively, three printing steps, the respective toner images being printed onto the carrier material 18 or, respectively, onto an intermediate carrier material 210 in chronological succession.

Part a of FIG. 7 shows the repetition printing wherein the toner images are directly superimposed on the carrier material 18. With the assistance of a printer unit 212 that is located in a printer unit receptacle 214, a first toner image is applied onto the photoconductor present in the printer unit 212 in a first printing step. With the assistance of a corona means 216, the first toner image is applied onto the carrier material 18 moving in the direction of an arrow 218. The printer unit 212 is constructed essentially like the printer unit 60. When printing the first toner image, the print controller 34 activates one or two developer stations that apply color particles having the desired colors onto the photoconductor.

After the transfer of the toner image onto the carrier material 18, this is conveyed back by the conveyor means 16 in the direction of an arrow 220 opposite the conveying direction 218 when transferring the toner images. In further printing steps, further toner images are superimposed on the first toner image, whereby the printer controller 34 respectively activates different developer stations in the printer unit 212.

Part b of FIG. 7 shows the repetition printing onto the intermediate carrier material 210 with a printer unit 212'. A return transport of the carrier material 18 can be eliminated and is replaced by arresting the carrier material 18. The intermediate carrier material is guided by two deflection rollers 222 and circulates in the fashion of a conveyor belt. At every revolution of the intermediate carrier material 210, a toner image can be applied onto the location provided for the print image. When all toner images have been applied, the transfer of the superimposed toner images onto the carrier material 18 ensues with the assistance of a corona means 224. To that end, the carrier material 18 is moved synchronously with the intermediate carrier material for the duration of an intermediate carrier material revolution.

The printer unit 212 is located in a printer unit receptacle 214 and a printer unit 212' is located in a printer unit receptacle 214'. When further printer units are inserted into the printer unit receptacle 214 or, respectively, 214', then the print controller 34 switches from repetition printing to parallel printing.

A both-sided repetition printing is also provided by employing a further print unit receptacle.

Although other modifications and changes may be suggested by those skilled in the art, it is the intention of the inventors to embody within the patent warranted hereon all changes and modifications as reasonably and properly come within the scope of their contribution to the art.

We claim:

1. An electrophotographic printer for multi-color printing of a final image carrier, comprising:

a conveyor for conveying the final image carrier, a first printer unit for generating a first toner image on a basis of a first arrangement of color particles on a first photoconductor, at least one further printer unit for generating a further toner image on a basis of a further arrangement of color particles on a further photoconductor, a transfer station for transfer of the first toner image from the first photoconductor and of the further toner image from the further photoconductor onto a surface section on the front side of the final image carrier, and an assembly for acceptance of the first printer unit in a first receptacle and for acceptance of a further printer unit in a further receptacle, a first developer station for application of color particles of a first color with a first polarity onto a first surface element of the first photoconductor, a second developer station contained in the first printer unit for applying color particles of a second color different from the first color with a second polarity opposite the first polarity onto a second surface element of the first photoconductor.

2. An electrophotographic printer according to claim 1, wherein first receptacle and the further receptacle have essentially the same structure; and at least one of the first printer unit and the further printer unit is releasably inserted into the assembly.

3. An electrophotographic printer according to claim 1, further comprising:

at least one additional printer unit for generating an additional toner image on a basis of an additional arrangement of color particles on an additional photoconductor, a second transfer station for transfer of the additional toner image from the additional photoconductor onto a surface section on a back side of the final image carrier, and a second assembly for acceptance of the additional printer unit in an additional receptacle.

4. An electrophotographic printer according to claim 3, wherein the additional receptacle has essentially the same structure as the first receptacle and the further receptacle; and the additional printer unit being releasably inserted into the second assembly.

5. An electrophotographic printer according to claim 3, wherein the first transfer means includes:

a first transfer unit allocated to the first printer unit which transfers the first toner image directly from the first photoconductor onto the front-side surface section; and a further transfer unit allocated to the further printer unit that transfers the further toner image directly from the further photoconductor onto the front-side surface section; and the second transfer means includes:

an additional transfer unit allocated to the additional printer unit that transfers the additional toner image directly from the additional photoconductor onto the back-side surface section.

6. An electrophotographic printer according to claim 1, wherein the first transfer station includes a first transfer unit allocated to the first printer unit that transfers the first toner image from the first photoconductor onto a surface section of an intermediate carrier; and a further transfer unit allocated to the further printer unit that transfers the further toner image from the further photoconductor onto the surface section of the intermediate carrier; and an intermediate carrier transport to conduct the intermediate carrier past a transfer location close to the front side of the final image carrier so that the toner images are transferred from the intermediate carrier to the front-side surface section at the transfer location.

7. An electrophotographic printer according to claim 3, wherein the second transfer station includes an additional transfer unit allocated to the additional printer unit that transfers the additional toner image from the additional photoconductor onto a surface section of a second intermediate carrier; and a second intermediate carrier transfer conveys the second intermediate carrier past at a second transfer location close to the back side of the final image carrier so that the additional toner image is transferred from the second intermediate carrier onto the back-side surface section at the second transfer location.

8. An electrophotographic printer according to claim 1, further comprising:

a third toner image generator in at least one of the printer units in the first assembly which generates a third toner image before or after the application of the first and of the second toner image, said third toner image being transferred by the first transfer station onto the front-side surface section; and the additional printer unit generates a toner image before or after the application of the additional toner image, said toner image being transferred by the second transfer station onto the back-side surface section.

9. An electrophotographic printer according to claim 1, wherein at least the first and the further toner image contains at least one first picture element of a first color and at least one second picture element of a second color different from the first color.

10. An electrophotographic printer according to claim 1, wherein the following are contained in at least two of the printer units:

a charging station arranged close to a photoconductor for generating an electrical charge of at least a part of the photoconductor;

an illumination station for image-wise illumination of the photoconductor;

a first developer station for applying the color particles of the first color onto at least one surface element of the photoconductor with a first polarity;

a second developer station for applying the color particles of the second color onto at least a second surface element of the photoconductor with a second polarity.

11. An electrophotographic printer according to claim 1, further comprising:

a print controller for selecting colors from a color pallet having a plurality of predetermined colors, whereby a developer station from one of the printer units is allocated to each individual color of the color pallet; the print controller activates developer stations for applying the selected colors; and at least one additional developer station in a quiescent condition during printing wherein no color particles are applied by the additional developer station.

12. An electrophotographic printer according to claim 1, further comprising:

at least one developer station releasably inserted into the printer units.

13. An electrophotographic printer according to claim 1, further comprising:

a single fixing station for fixing the toner images at least on the front side and/or the back side of the final image carrier.

* * * * *